US012768573B2

(12) United States Patent
Ramanujam et al.

(10) Patent No.: US 12,768,573 B2
(45) Date of Patent: Oct. 20, 2026

(54) $CO_2$ UTILIZATION BY LOW TEMPERATURE HEAT UPGRADATION FOR IMPROVED ENERGY EFFICIENCY

(71) Applicant: J. Ray McDermott, S.A., Houston, TX (US)

(72) Inventors: Venkata Krishnan Ramanujam, Sugar Land, TX (US); Venkata Appala Nuti, Katy, TX (US); Michael Nawrocki, Houston, TX (US)

(73) Assignee: J. Ray McDermott, S.A., Houston, TX (US)

( * ) Notice: Subject to any disclaimer, the term of this patent is extended or adjusted under 35 U.S.C. 154(b) by 298 days.

(21) Appl. No.: 18/216,171

(22) Filed: Jun. 29, 2023

(65) Prior Publication Data

US 2024/0003596 A1 Jan. 4, 2024

Related U.S. Application Data

(60) Provisional application No. 63/367,395, filed on Jun. 30, 2022.

(51) Int. Cl.

| | |
|---|---|
| ***F25B 9/06*** | (2006.01) |
| ***F25B 9/00*** | (2006.01) |
| ***F25B 27/02*** | (2006.01) |

(52) U.S. Cl.

CPC ..... *F25B 9/008* (2013.01); *F25B 9/06* (2013.01); *F25B 27/02* (2013.01)

(58) Field of Classification Search

CPC ..... F25B 9/008; F25B 9/004; F25B 9/006; F25B 9/002; F25B 9/06; F25B 9/00; F25B 27/02

See application file for complete search history.

(56) References Cited

U.S. PATENT DOCUMENTS

| | | | | |
|---|---|---|---|---|
| 3,889,485 | A | 6/1975 | Swearingen | |
| 2014/0000298 | A1* | 1/2014 | Lopez | F25B 27/02 62/238.3 |
| 2016/0096629 | A1 | 4/2016 | Vaisman | |
| 2017/0010043 | A1 | 1/2017 | Ducote et al. | |
| 2021/0341221 | A1* | 11/2021 | Mak | F25J 1/005 |

FOREIGN PATENT DOCUMENTS

| | | | |
|---|---|---|---|
| AU | 2016291205 | A1 | 2/2018 |

OTHER PUBLICATIONS

International Search Report and Written Opinion for Application No. PCT/US2023/026604 dated Oct. 5, 2023.

Saudi Arabian Office Action for Application No. 1120247507 dated Jul. 28, 2026.

* cited by examiner

*Primary Examiner* — Miguel A Diaz

(74) *Attorney, Agent, or Firm* — Patterson + Sheridan, LLP

(57) ABSTRACT

Embodiments of the present disclosure generally relate to industrial infrastructures. More specifically, embodiments described herein provide for a fluid recirculation system of an industrial infrastructure and a method of using the recirculation system. The system utilizes exhaust from industrial infrastructures as a refrigerant to ensure a constant supply of refrigerant while also utilizing any low level heat still within the exhaust. Heat exchangers are provided that both heat and cool process fluids using the refrigerant supplied originally as an exhaust from the industrial infrastructure.

14 Claims, 4 Drawing Sheets

$CO_2$ UTILIZATION BY LOW TEMPERATURE HEAT UPGRADATION FOR IMPROVED ENERGY EFFICIENCY

CROSS-REFERENCE TO RELATED APPLICATIONS

This application claims priority to U.S. Patent Application Ser. No. 63/367,395, filed Jun. 30, 2022, which is herein incorporated by reference.

BACKGROUND

Field

Embodiments of the present disclosure generally relate to industrial infrastructures. More specifically, embodiments described herein provide for a fluid recirculation system of an industrial infrastructure and a method of using the recirculation system.

Description of the Related Art

Carbon dioxide ($CO_2$) is a predominant by-product of several industrial and everyday processes. $CO_2$ is produced by power plant, by liquefied natural gas (LNG) production, in refining, in petrochemical production, in steel production, by vehicles, and the like. $CO_2$ is often treated as waste and vented to atmosphere. Accordingly, what is needed in the art is a fluid recirculation system of an industrial infrastructure and a method using the recirculation.

For many of the above processes, liquid water or steam is utilized as a heating or cooling agent. Water is a generally abundant and cheap resource. However, the use of water and steam as a heat transfer medium requires complex infrastructure to manage the transformation of water to steam and vice versa. Further, the process receives water from an outside water source in order to recover any water that is lost through venting of steam or by leaking from the cooling system. In order to ensure a consistent supply of water, process plants are typically placed close to a water source or include a water reservoir on-site. Power may also be needed to increase the temperature of water or steam to an acceptable level for use at the beginning of a process.

Therefore, what is needed is an improved process apparatus and methods for reducing heating/cooling costs of industrial processes.

SUMMARY

Systems and methods for heating and/or cooling in an open-loop system are provided herein.

In one embodiment, a system is provided. The system includes an exhaust fluid input conduit, a compressor fluidly coupled to the exhaust fluid input conduit via a compressor inlet line, an expander fluidly coupled to the compressor, and a heat exchanger disposed fluidly between the compressor and the expander. The heat exchanger receives a fluid from the compressor and fluid output by the compressor is input into the expander. The system further includes one or more fluid outlet conduits.

In another embodiment, a system is provided. The system includes a piece of infrastructure, an exhaust fluid input conduit fluidly coupled to an exhaust of the piece of infrastructure, a compressor fluidly coupled to the exhaust fluid input conduit via a compressor inlet line, an expander fluidly coupled to the compressor, and a first heat exchanger disposed fluidly between the expander and the compressor. The first heat exchanger receives a fluid from the expander and fluid output by the first heat exchanger is input into the compressor. A second heat exchanger is disposed fluidly between the compressor and the expander, such that the second heat exchanger receives a fluid from the compressor and fluid output by the second heat exchanger is input into the expander. The system further includes one or more fluid outlet conduits.

In another embodiment, a method of operating a heating and cooling system is provided. The method includes receiving an exhaust gas from a piece of infrastructure, compressing the exhaust gas using a compressor, running the exhaust gas through a first heat exchanger, expanding the exhaust gas using an expander, and running the exhaust gas through a second heat exchanger.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
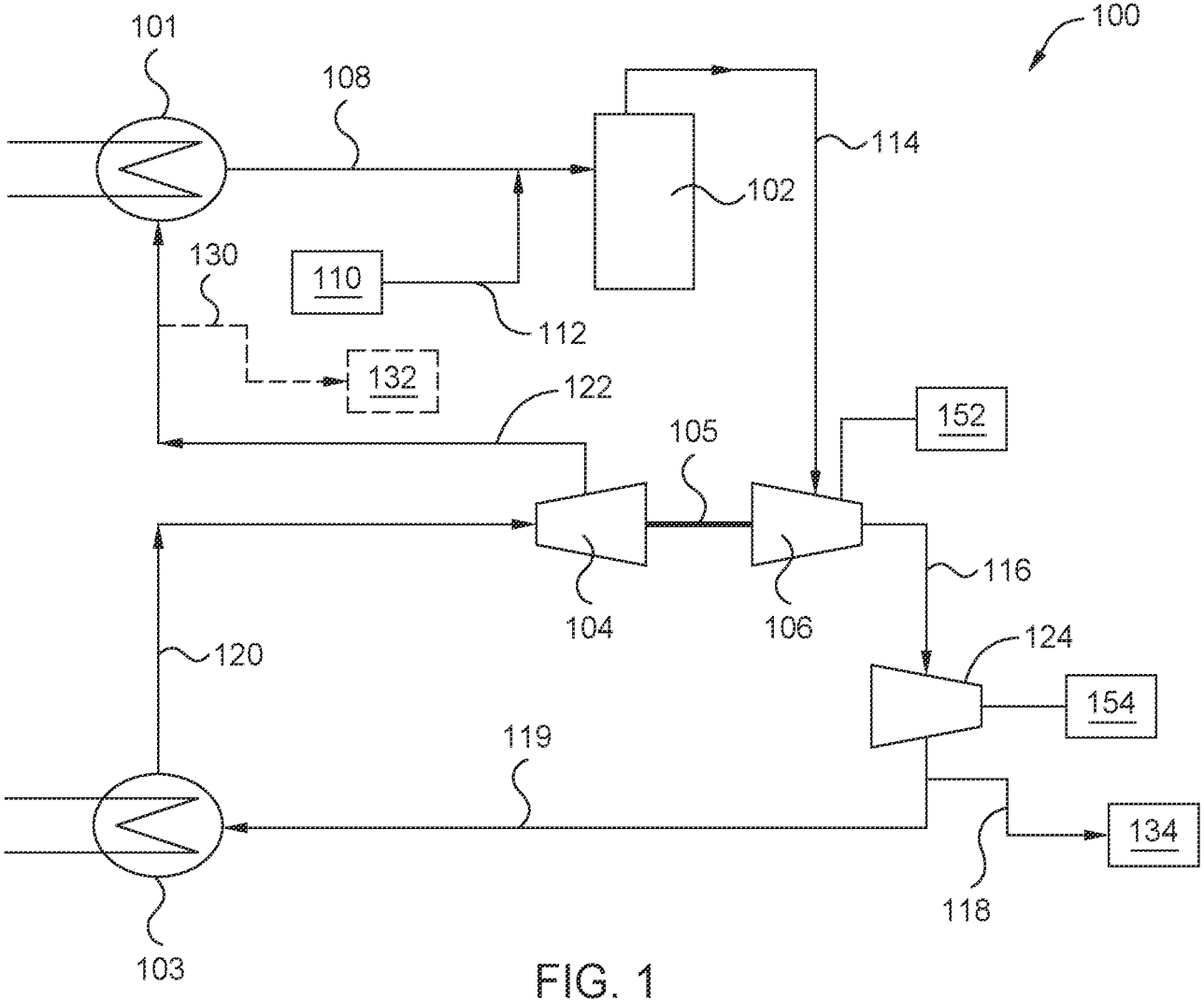
FIG. 1 is a schematic view of a heating and cooling system, according to embodiments described herein.

Embodiments of the present disclosure generally relate to industrial infrastructures. More specifically, embodiments described herein provide for a fluid recirculation system of an industrial infrastructure and a method using the recirculation system.

$CO_2$ is one of the primary greenhouse gases. $CO_2$ is also a relatively efficient heat transfer medium for transporting energy. Described herein are apparatus and corresponding methods for utilizing $CO_2$ produced by one or more processes for heating and cooling components of some form of infrastructure. Different forms of infrastructure include power plants, LNG plants, refineries, steel production plants, and the like. The apparatus may include a fluid recirculation system that can be attached to one or more pieces of equipment within a facility. The equipment includes, but is not limited to, solvent regenerator heating and cooling systems, heaters or power producing equipment, coolers, and condensers.

The apparatus described herein may be a modular package, such that the apparatus may be easily attached to existing infrastructure without a substantial redesign of the infrastructure itself. The apparatus may also be used with other refrigerants or process exhaust gases, such as hydrogen sulfide ($H_2S$) or a mixture of $CO_2$ and $H_2S$.

The fluid recirculation system described makes use of the energy within exhaust gases, such as $CO_2$, which would otherwise be exhausted from the system into the atmosphere. Even if heat exchangers are used to transfer energy from the exhaust gases to water or steam, the energy transfer would be limited by the efficiency of the heat exchanger. Further, the use of heat exchangers would only increase the complexity of the system and increase the maintenance/capital costs of the facility. However, if the exhaust itself is utilized as a refrigerant, then the energy within the exhaust can be fully utilized and the complexity of the system may be decreased. Further, the use of exhaust as a refrigerant allows the system to be self-refilling and there is no need for a separate refrigerant source, such as a nearby water reservoir. Therefore, the location of infrastructure facilities may be decoupled from the presence of water reservoirs and artificial water reservoirs would be unnecessary. The elimination of infrastructure for transferring water from a reservoir to a facility, as well as the elimination of any capital investment in building an artificial reservoir, enable a reduction in the capital costs and maintenance costs of the fluid recirculation system compared to more conventional water or steam heating/cooling systems.

It is estimated that the use of $CO_2$, or other exhaust gases, as a refrigerant can decrease the operating costs of heating and cooling systems by upwards of 40% compared to conventional steam, cooled water, or air heating/cooling systems. The reduction in operating costs is due, at least in part, to a reduction in energy used by the heating/cooling systems. The reduction in energy usage may also reduce the overall carbon footprint of the heating/cooling systems as less fuel is burned to operate the system and the $CO_2$ may be exhausted at a low energy level which can be more easily sequestered.

FIG. 1 is a schematic view of a system 100. The system 100 includes a collection vessel 102, an expander 104, one or more compressors 106, 124, and one or more heat exchanger systems 101, 103. The system 100 is configured to be attached to one or more pieces of infrastructure. The system 100 may be coupled to the existing infrastructure at each of the one or more heat exchanger systems 101, 103 and one or more circulating fluid sources 110. The system 100 may also be coupled to existing infrastructure at one or more system outlets 132, 134.

The collection vessel 102 is a manifold, a receiver, or a surge drum. The collection vessel 102 enables overflow fluid from the rest of the system to be deposited therein and reduces the amount of surging which may otherwise occur within the system 100. The collection vessel 102 may be a metal drum. The collection vessel 102 may be coupled to an outlet of a first heat exchanger system 101 via a first system line 108, such that the first system line 108 extends between the collection vessel 102 and the first heat exchanger system 101. Fluid from the first heat exchanger system 101 is discharged into the first system line 108 and flowed into the collection vessel 102.

The collection vessel 102 may also be coupled to a circulating fluid source 110 via a source line 112. The circulating fluid source 110 may be an exhaust fluid source from a system to which the system 100 is coupled. The circulating fluid source 110 may therefore supply exhaust $CO_2$ to the system 100 which is utilized as a refrigerant. Other exhaust gases may also be supplied, such as $H_2S$ or a combination of $H_2S$ and $CO_2$.

The collection vessel 102 is coupled to the compressor 106 via a compressor inlet line 114. The compressor inlet line 114 connects an outlet of the collection vessel 102 to an inlet of the compressor 106, such that the compressor 106 is in fluid communication with the collection vessel 102. The compressor inlet line 114 may also be referred to as a second system line. When the collection vessel 102 is filled with a $CO_2$ gas, the $CO_2$ is delivered to an inlet of the compressor 106 via the compressor inlet line 114.

The compressor 106 may be a gas compressor and is configured to raise both a temperature and a pressure of a gas as it enters the compressor 106. Therefore, a gas which is run through the compressor 106 may go from a first temperature $T_1$ and a first pressure $P_1$ to a second temperature $T_2$ and a second pressure $P_2$. The compressor 106 is coupled to an expander 104 via a dual-shaft 105. The dual-shaft 105 connecting the compressor 106 and the expander 104 enables the compressor 106 to be run without a secondary energy source, such that the expander 104 generates the power which runs the compressor 106. The dual-shaft 105 transfers the power from the expander 104 to the compressor 106. One or both of the expander 104 and the compressor 106 may also receive power from an external power source 152 in addition to any power generated by the expander 104.

The compressor 106 is coupled to a compressor outlet line 116. The compressor outlet line 116 extends from an outlet of the compressor 106 to an inlet of a secondary compressor 124. The compressor outlet line 116 may also be referred to as a third system line. The compressor outlet line 116 extends between the compressor 106 and the secondary compressor 124 and fluidly connects the compressor 106 to the secondary compressor 124.

In some embodiments, the secondary compressor 124 may be multiple secondary compressors, such that there may be three or more compressors total or two or more compressors total. The secondary compressor 124 is coupled to an external power source 154, which is similar to the external power source 152 which is optionally coupled to the expander 104 or the compressor 106. The external power source 154 coupled to the secondary compressor 124 is utilized to provide power so the secondary compressor 124 can increase the temperature and pressure of a refrigerant run through the secondary compressor 124. The secondary compressor 124 therefore brings the temperature of the refrigerant up from the second temperature $T_2$ to a third temperature $T_3$. Likewise, the pressure of the refrigerant is increased from a second pressure $P_2$ to a third pressure $P_3$.

A fourth system line 119 extends between an outlet of the secondary compressor 124 and an inlet of a second heat exchanger system 103. The fourth system line 119 fluidly connects the secondary compressor 124 to the second heat exchanger system 103, such that refrigerant is flowed from the outlet of the secondary compressor 124 and into the second heat exchanger system 103

An outlet line 118 may branch off from the fourth system line 119, such that the outlet line 118 is fluidly coupled to the fourth system line 119. The outlet line 118 may extend to a system outlet 134. The system outlet 134 may be an outlet to another system or may be a vent to atmosphere. The system outlet 134 may include one or more valves, such as bleed off valves, such that fluid is only flowed into the system outlet 134 and out of the system 100 through the outlet line 118 in order to relieve pressure within the system 100. As pressure builds within the system 100 due to a continuous input of exhaust through the circulating fluid source 110, a pressure release may be desired. In some embodiments, the outlet line 118 has heat recovered into the compressor inlet line 114 through a third heat exchanger (not shown).

The second heat exchanger system 103 may be similar to the first heat exchanger system 101. The second heat exchanger system 103 includes the refrigerant from the fourth system line 119 as a first fluid therein while a second fluid is a cold fluid from a second system that is meant to be heated by the first fluid in the fourth system line 119. Therefore, the second heat exchanger system 103 includes a second inlet and a second outlet through which a second fluid is flowed into and out of the second heat exchanger system 103. The second heat exchanger system 103 may also be considered a reboiler or a reclaimer. The temperature of a refrigerant within the second heat exchanger system 103 will decrease from the third temperature $T_3$ at the inlet of the second heat exchanger system 103 to a fourth temperature $T_4$ at an outlet of the second heat exchanger system 103.

The refrigerant is then flowed to the expander 104 while at the fourth temperature $T_4$. The expander 104 may be coupled to an outlet of the second heat exchanger system 103 via a fifth system line 120. The fifth system line 120 extends between an outlet of the second heat exchanger system 103 and an inlet of the expander 104. Therefore, a heat exchanger outlet of the second heat exchanger system 103 is coupled to an expander inlet of the expander 104 by an expander inlet line, such as the fifth system line 120. The fifth system line 120 fluidly connects the second heat exchanger system 103 and the expander 104, such that a fluid flowed from the second heat exchanger system 103 enters the expander 104.

The expander 104 is configured to reduce both the pressure and the temperature of the refrigerant. Therefore, the temperature of the refrigerant drops from the fourth temperature $T_4$ to a fifth temperature $T_5$. The pressure of the refrigerant drops from the third pressure $P_3$ to a fourth pressure $P_4$. The fourth pressure $P_4$ may match or substantially match the first pressure $P_1$. The expander 104 also produces power. The power produced by the expander 104 may be utilized to run the compressor 106. The power is transferred from the expander 104 to the compressor 106 via the dual-shaft 105. The expander 104 may be a commercial grade expander configured to operate with $CO_2$ refrigerants.

The expander 104 may be coupled to an inlet of the first heat exchanger system 101 via a sixth system line 122. The sixth system line 122 extends between an outlet of the expander 104 and the inlet of the first heat exchanger system 101. The sixth system line 122 fluidly connects the expander 104 and the first heat exchanger system 101 and is configured to carry a refrigerant. An expander outlet of the expander is coupled to a heat exchanger inlet of the first heat exchanger system 101 by an expander outlet line, such as the sixth system line 122. A heat exchanger outlet of the first heat exchanger system 101 is connected to the collection vessel 102 by a collection vessel inlet line, such as the first system line 108.

An outlet line 130 may branch off from the sixth system line 122, such that the outlet line 130 is fluidly coupled to the sixth system line 122. The outlet line 130 may extend to a system outlet 132. The system outlet 132 may be an outlet to another system or may be a vent to atmosphere. The system outlet 132 may include one or more valves, such as bleed off valves, such that fluid is only flowed into the system outlet 132 and out of the system 100 through the outlet line 130 in order to relieve pressure within the system 100. As pressure builds within the system 100 due to a continuous input of exhaust through the circulating fluid source 110, a pressure release may be desired. The outlet line 130 is optional. Relieving the pressure through the outlet line 130 enables the refrigerant to be exhausted while at it's lowest energy point within the system 100. Therefore, the system outlet 132 may lead to a recovery system or a carbon sequestration system to be liquefied.

The first heat exchanger system 101 is similar to the second heat exchanger system 103. The first heat exchanger system 101 has both a first fluid and a second fluid running therethrough. The first fluid is the refrigerant, which is delivered by the sixth system line 122. The second fluid is a hot fluid that enters the first heat exchanger system 101 through a second inlet and leaves the first heat exchanger system 101 through a second outlet. The second fluid is cooled while within the first heat exchanger system 101 since the temperature of the refrigerant is low when it enters the first heat exchanger system 101. Therefore, the temperature of the refrigerant enters the first heat exchanger system 101 at the fifth temperature $T_5$, but leaves the first heat exchanger system 101 at a sixth temperature, which may be similar to the first temperature $T_1$, through the first system line 108. A compressor outlet of the compressor 106 is coupled to the second heat exchanger by one or more compressor outlet lines.

Figure 2:
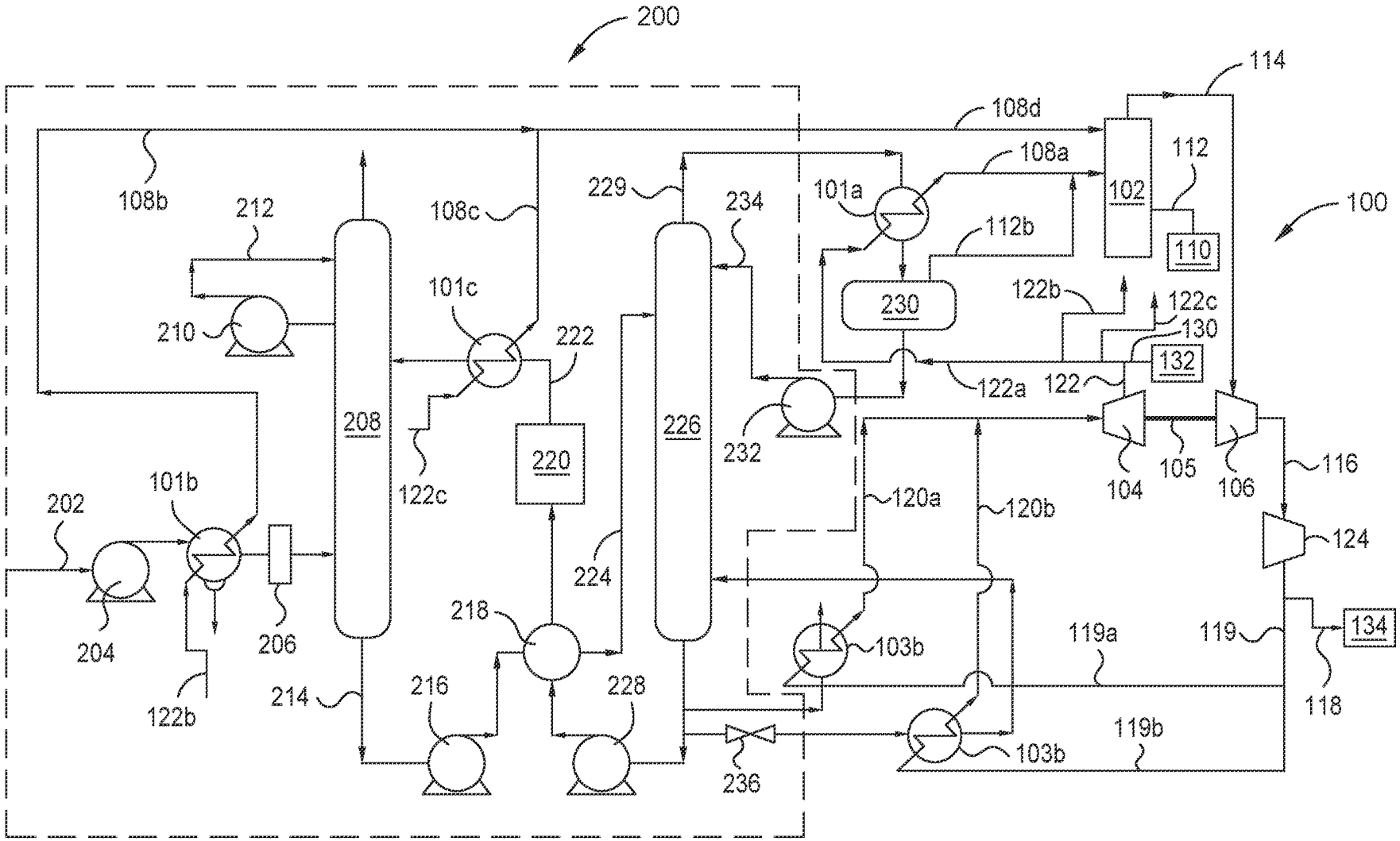
FIG. 2 is a schematic view of an infrastructure utilizing the heating and cooling system of FIG. 1, according to embodiments described herein.

The system 100 is a modular system operable to be coupled to some form of infrastructure that utilizes a circulating fluid, such as the infrastructure 200 of FIG. 2. In one example, the infrastructure 200 is a refinery complex. The circulating fluid includes carbon dioxide ($CO_2$), hydrogen sulfide ($H_2S$), with some water ($H_2O$) content or combinations thereof. The circulating fluid may be pre-filtered to only include $CO_2$, $H_2S$, or a combination of $CO_2$ and $H_2S$. In certain applications, this stream may also include nitrogen and oxygen.

The system 100 is operable to recirculate the circulating fluid to provide the circulating fluid at a low-temperature and low-pressure to components of the first heat exchanger system 101 and provide the circulating fluid at a high-temperature and high-pressure to components of the second heat exchanger system 103. Low temperature described herein is about 10° C. to about 100° C. Low pressure described herein is full Vacuum to about 50 bar. High temperature described herein is 70° C. to about 175° C. High pressure described herein is about 0 bar to about 75 bar. In operation, a low-temperature and low-pressure circulating fluid is output by the first heat exchanger system 101. The low-temperature and low-pressure circulating fluid and the circulating fluid from the circulating fluid source 110 is then provided to the collection vessel 102 via the outlet of a first heat exchanger system 101. The low-temperature and low-pressure circulating fluid flows to the compressor 106 where the circulating fluid is compressed such that the circulating fluid has a high-temperature and high-pressure. A first portion of the high-temperature and high-pressure circulating fluid may be output via the outlet line 118. A second portion of the high-temperature and high-pressure circulating fluid is provided to the components of the second heat exchanger system 103. High-temperature and high-pressure circulating fluid output by components of the second heat exchanger system 103 is provide to the expander 104 where the circulating fluid is expanded such that the circulating fluid has a lower temperature and a lower pressure. The low-temperature and low-pressure circulating fluid is provided to components of the first heat exchanger system 101.

In embodiments described herein, energy output by the expander 104 powers the compressor 106. In some embodiments, the system 100 may include additional condensers and additional reboilers. The additional condensers and the additional reboilers are distributed in multiple applications throughout a complex.

FIG. 2 is a schematic view of a piece of infrastructure 200, such as a piece of energy infrastructure. In one example, the infrastructure 200 is a refinery complex. The infrastructure 200 may also be a power plant, a liquefied natural gas production plant, a petrochemical production plant, or a steel production plant. The first heat exchanger system 101 includes a first set of components, which utilize a low-temperature and low-pressure circulating fluid, and the second heat exchanger system 103 includes a second set of components, which utilize a high-temperature and high-pressure circulating fluid. The first heat exchanger system 101 therefore may be a first set of heat exchangers and may include a first heat exchanger 101*a*, a second heat exchanger 101*b*, and a third heat exchanger 101*c*. The second heat exchanger 101*b* is a feed gas cooler. Each of the first heat exchanger 101*a*, the second heat exchanger 101*b*, and the third heat exchanger 101*c* are configured to heat a second fluid from the infrastructure 200 which is flowed therethrough. In operation, an intermediate-temperature and low-pressure circulating fluid is output by each of the first heat exchanger 101*a*, the second heat exchanger 101*b*, and the third heat exchanger 101*c*. The circulating fluid is at a temperature between the hot-temperature and the low-temperature. The intermediate temperature may be similar to a temperature of a circulating fluid that is exhausted from the infrastructure 200 into the system 100 from one or more circulating fluid sources 110.

In the infrastructure 200 of FIG. 2, the circulating fluid source may include both a knock-out drum 230 and one or more other circulating fluid sources 110. The circulating fluid is flowed to the collection vessel 102 from each of the first heat exchanger 101*a*, the second heat exchanger 101*b*, the third heat exchanger 101*c*, the knock-out drum 230, and the circulating fluid source 110 via the first system line 108 and the source line 112. The first system line 108 may have a plurality of branches 108*a*, 108*b*, 108*c*, 108*d* that lead from one or more of the first heat exchanger 101*a*, the second heat exchanger 101*b*, and the third heat exchanger 101*c*. The branches may merge or split apart between the first heat exchanger 101*a*, the second heat exchanger 101*b*, and the third heat exchanger 101*c* and the collection vessel 102.

The source line 112 may be a first source line 112*a* leading from a circulating fluid source 110 and a second source line 112*b* disposed between the knock-out drum 230 and the collection vessel 102. In some embodiments, only the knock-out drum 230 supplies a circulating fluid from the infrastructure 200 and there is no separate circulating fluid source 110. The one or more source lines 112*a*, 112*b* may merge with one of the branches 108*a*, 108*b*, 108*c*, 108*d*. The source lines 112*a*, 112*b* may merge with a first branch 108*a* that exits the first heat exchanger 101*a* before the first branch 108*a* empties into the collection vessel 102. The one or more source lines 112*a*, 112*b* may also be referred to as a compressor inlet line and the one or more source lines 112*a*, 112*b* are connected to a compressor inlet of the first compressor 106.

The circulating fluids flowed from each of the first heat exchanger 101*a*, the second heat exchanger 101*b*, the third heat exchanger 101*c*, and the knock-out drum 230 may be at different temperatures or pressures. The collection vessel 102 may mix the circulating fluids flowed from the various sources, such that the circulating fluid may be output from the collection vessel 102 at a uniform temperature and pressure.

Each of the first heat exchanger 101*a*, the second heat exchanger 101*b*, and the third heat exchanger 101*c* are configured to cool a second fluid which is input from the infrastructure 200. Therefore, heat from the second fluid is transferred to the circulating fluid within the system 100 within each of the first heat exchanger 101*a*, the second heat exchanger 101*b*, and the third heat exchanger 101*c*.

A low-temperature and low-pressure circulating fluid is input into each of the first heat exchanger 101*a*, the second heat exchanger 101*b*, and the third heat exchanger 101*c* via the sixth system line 122. The sixth system line 122 may branch into one or more expander outlet lines, such as a first expander outlet line 122*a*, a second expander outlet line 122*b*, and a third expander outlet line 122*c*. The first expander outlet line 122*a* transfers a circulating fluid from the expander 104 to an inlet of the first heat exchanger 101*a*. The second expander outlet line 122*b* transfers a circulating fluid from the expander 104 to an inlet of the second heat exchanger 101*b*. The third expander outlet line 122*c* transfers a circulating fluid from the expander 104 to an inlet of the third heat exchanger 101*c*.

The second heat exchanger system 103 may include multiple heat exchangers. When the system 100 is integrated into the infrastructure 200, the second heat exchanger system 103 includes at least a fourth heat exchanger 103*a* and a fifth heat exchanger 103*b*. The fourth heat exchanger 103*a* may be a reboiler while the fifth heat exchanger 103*b* is a reclaimer. Each of the fourth heat exchanger 103*a* and the fifth heat exchanger 103*b* receive a high-temperature and high-pressure circulating fluid from one of the compressor 106 or the one or more secondary compressors 124.

In the embodiment of FIG. 2, a circulating fluid is flowed from the one or more secondary compressors 124 to each of the fourth heat exchanger 103*a* and the fifth heat exchanger 103*b* using the fourth system line 119. The fourth system line 119 may include one or more branches or offshoots, such as a first branch 119*a* and a second branch 119*b*. The first branch 119*a* is disposed between and flows a circulating fluid from the secondary compressor 124 to the fourth heat exchanger 103*a*. The second branch 119*b* is disposed between and flows a circulating fluid from the secondary compressor 124 to the fifth heat exchanger 103*b*. In other embodiments, the circulating fluid may be flowed to each of the fourth heat exchanger 103*a* and the fifth heat exchanger 103*b* directly from a compressor outlet line 116.

The circulating fluid output by the fourth heat exchanger 103*a* and the fifth heat exchanger 103*b* is provided to the expander 104 via the fifth system lines 120*a*, 120*b*. The temperature of the circulating fluid as it leaves the fourth heat exchanger 103*a* and the fifth heat exchanger 103*b* is lower than when entering the fourth heat exchanger 103*a* and the fifth heat exchanger 103*b*. However, process fluids that are flowed into the fourth heat exchanger 103*a* and the fifth heat exchanger 103*b* from the infrastructure 200 is heated and exits the fourth heat exchanger 103*a* and the fifth heat exchanger 103*b* at a higher temperature.

The infrastructure 200 includes a plurality of pumps 204, 210, 216, 228, 232. Each of the pumps 204, 210, 216, 228, 232 may be configured to pump one or both of a gas or a liquid. The infrastructure 200 further includes an absorber 208 and a stripper 226. The absorber 208 may be an absorber column for use in an oil refining or natural gas refining facility. The absorber 208 washes a gas within the absorber using a liquid, such as water or another solvent. The stripper 226 may be a stripper column as used in an oil refining or natural gas refining facility. The stripper 226 is used to remove unwanted materials from a process stream, such as the removal of ammonia, $H_2S$, or $CO_2$ from water or another solvent. In some embodiments, there may be a condenser disposed along a conduit 229 that connects the stripper 226 to a heat exchanger, such as the first heat exchanger 101*a*.

A feed gas may enter the infrastructure 200 from a feed gas line 202. The feed gas is then flowed into a first pump 204 before flowing into the second heat exchanger 101*b* to be cooled. The feed gas may then be filtered through one or more filters or membranes 206. The filter or membrane 206 may be chosen to filter out gases or particles which are not $CO_2$, such that the percentage of $CO_2$ within the gas line exiting the filter or membrane 206 is increased compared to the percentage of $CO_2$ which enters the filter or membrane 206 through the feed gas line 202.

The gas is then flowed into a lower portion of the absorber 208. The absorber 208 includes a second pump 210 that is configured to circulate a water from the absorber 208, into a conduit 212 and into a top portion of the absorber 208. The water may absorb some components of the gas flowed into the absorber 208. A second solution may also be flowed into a middle portion of the absorber 208 from a filter 220 through a conduit 222. The solution at the bottom of the absorber 208 enters a conduit 214 which leads to a third pump 216. The third pump 216 pumps the solution to a solution exchanger 218. The solution exchanger 218 is a rich/lean solution exchanger and is configured to mix or exchange fluid flows from the third pump 216 and from a fourth pump 228 which delivers a solution from a bottom of the stripper 226. The solution exchanger 218 outputs a first solution into the conduit 222 and through the filter 220 before the first solution is cooled within the third heat exchanger 101*c* and flowed into the absorber 208. A second solution is output from the solution exchanger 218 and into a conduit 224 before the second solution enters a middle portion of the stripper 226.

The stripper 226 has a conduit 229 which carries a fluid, such as a gas or vapor, from the top of the stripper 226 and into the first heat exchanger 101*a*. The fluid is cooled and may condense inside of the first heat exchanger 101*a* before being flowed into the knock-out drum 230. The solution in the knock-out drum is then delivered to a fifth pump 232 and then to an upper portion of the stripper 226 using a conduit 234. Some of the solution within the knock-out drum 230 may still be in a vapor or a gas phase. The vapor or gas within the knock-out drum 230 may be substantially $CO_2$ gas or $H_2S$ gas. The vapor or gas may be exhausted from the infrastructure 200 to the system 100 through the second source line 112*b*.

At least some of the solution leaving the bottom of the stripper 226 goes to the fourth pump 228 and the solution exchanger 218. However, some of the solution exiting the stripper 226 goes to one or both of the fourth heat exchanger 103*a* and the fifth heat exchanger 103*b*. There may be a valve 236 restricting a flow of the fluid to the fifth heat exchanger 103*b* from the stripper 226. The valve 236 may limit the amount of fluid flowed to the fifth heat exchanger 103*b* or may only allow gases to pass therethrough and not liquids.

The system 100 is attached to the infrastructure 200 at several heat exchangers 101*a*, 101*b*, 101*c*, 103*a*, 103*b*. The system 100 utilized an exhaust gas from the knock-out drum 230 to supply the refrigerant for the system 100. Therefore, a separate supply of refrigerant is not needed or the need for a separate supply of refrigerant is greatly reduced.

Figure 3:
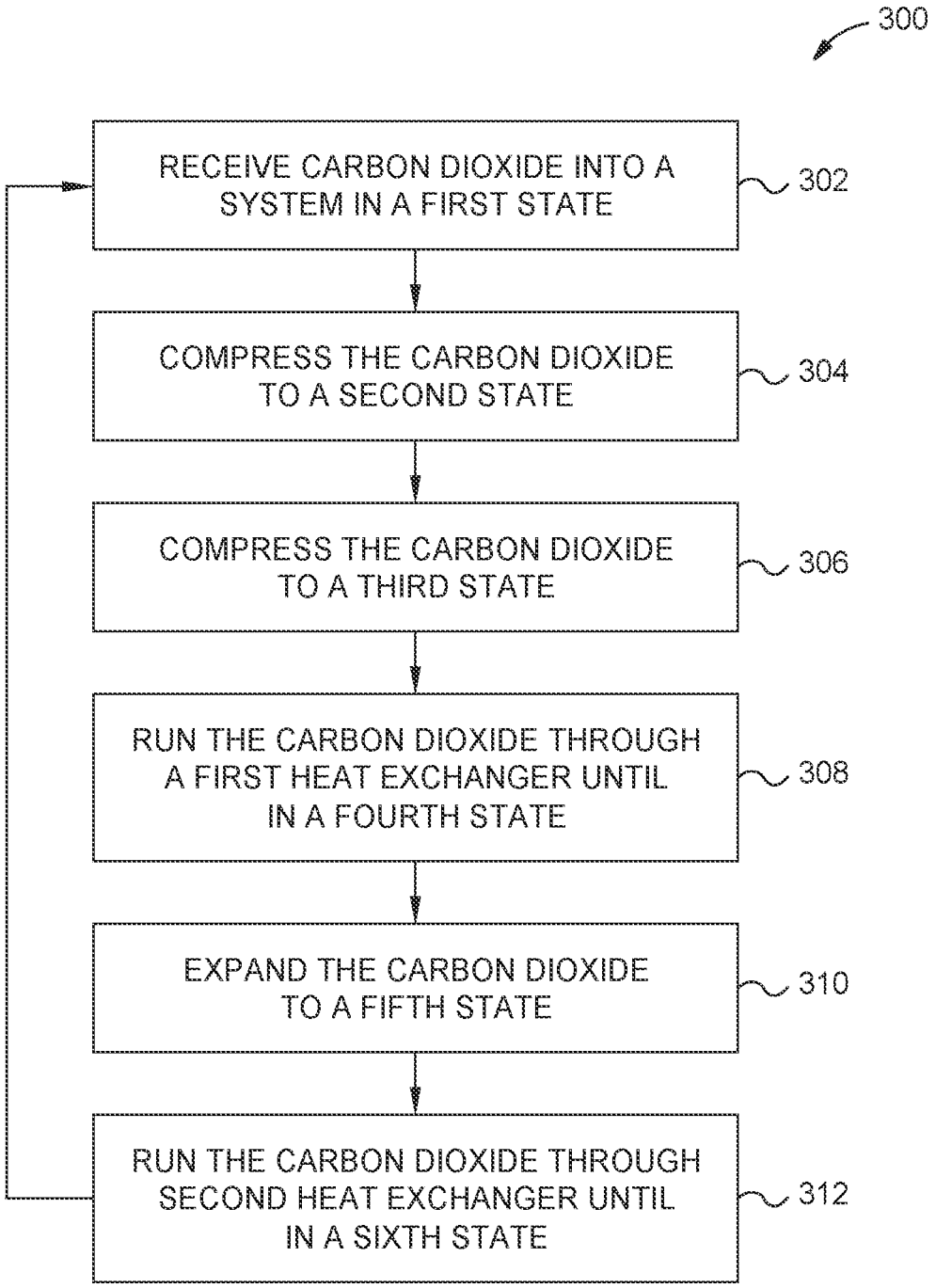
FIG. 3 is a method of utilizing the heating and cooling system of FIG. 1, according to embodiments described herein.

FIG. 3 is a method 300 of utilizing the heating and cooling system 100 of FIG. 1. The method 300 may be looped or repeated continuously, such that each of the operations 302, 304, 306, 308, 310, 312 are occurring simultaneously, but on different portions of a refrigerant fluid flow. In an operation 302, the system 100 receives a refrigerant gas, such as $CO_2$, from a circulating fluid source, such as one or both of the circulating fluid source 110 and the knock-out drum 230 of FIG. 2. The refrigerant may be substantially $CO_2$ or be a mixture of $CO_2$, $H_2S$, and water vapor. Other parts of the refrigerant mixture may include nitrogen and oxygen.

Figure 4B:
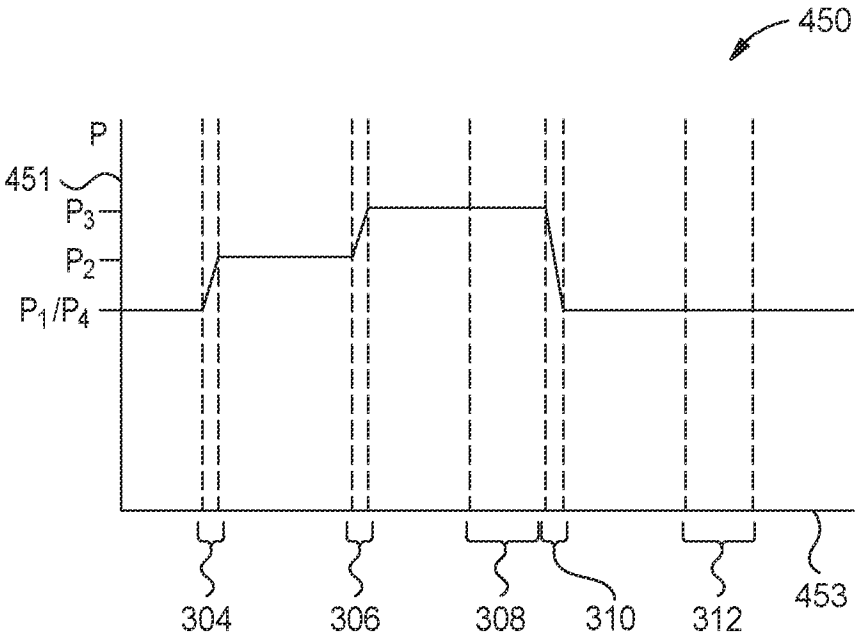
FIG. 4B is a graph illustrating a pressure of a fluid within the heating and cooling system of FIG. 1, according to embodiments described herein.
Figure 4A:
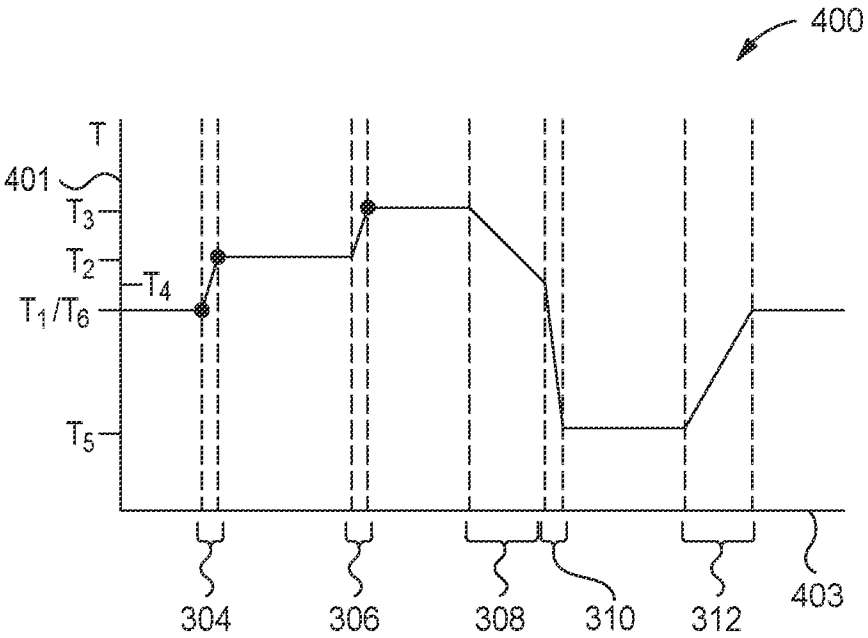
FIG. 4A is a graph illustrating a temperature of a fluid within the heating and cooling system of FIG. 1, according to embodiments described herein.

After the refrigerant is received during the operation 302, the refrigerant is compressed using a compressor portion of a compressor/expander or a stand-alone compressor during an operation 304. The compressor may be the compressor 106 of FIG. 1. FIG. 4A is a graph 400 illustrating a temperature of the refrigerant within the heating and cooling system 100. In the graph 400, the vertical axis 401 represents the temperature of the refrigerant while the horizontal axis 403 denotes the location within the method 300 and the system 100. FIG. 4B is a graph 450 illustrating a pressure of the refrigerant within the heating and cooling system 100. In the graph 450, the vertical axis 451 represents the pressure of the refrigerant while the horizontal axis 453 denotes the location within the method 300 and the system 100.

As shown in the graph 400 and the graph 450, the refrigerant has a first temperature $T_1$ and a first pressure $P_1$ as the refrigerant is received into the system during operation 302. A first temperature gradient and a first pressure gradient as the refrigerant travels from a circulating fluid source is about zero, such that the temperature and the pressure of the refrigerant stays about the same. In some embodiments, such as when there are multiple exhaust streams entering the collection vessel 102, the temperature and pressure of the refrigerant may change as the refrigerant is mixed with other streams of refrigerant. The refrigerant is at the first temperature $T_1$ and the first pressure $P_1$ when the refrigerant enters the compressor during operation 304. The refrigerant exits the compressor at a second temperature $T_2$ and a second pressure $P_2$. The second temperature $T_2$ and the second pressure $P_2$ is greater than the first temperature $T_1$ and the first pressure $P_1$ respectively.

After going through the first compressor, the refrigerant may go through an optional second compressor and be compressed to a third state during an operation 306. The temperature of the refrigerant may be relatively constant from the exit of the first compressor to the entrance of the second compressor through one or more conduits, such as the line 116. The refrigerant is brought from the second state to the third state in the compressor, such that the refrigerant leaves the compressor in the third state. The third state is a third temperature $T_3$ and a third pressure $P_3$. The third temperature $T_3$ and the third pressure $P_3$ are greater than the second temperature $T_2$ and the second pressure $P_2$.

After going through the compressor to reach the third state during the operation 306, the refrigerant is run through one or more first heat exchangers, such as a heat exchanger system 101, during an operation 308. Running the refrigerant through the one or more heat exchangers brings the refrigerant to a fourth state. The fourth state is a fourth temperature $T_4$ and the third pressure $P_3$. The pressure does not change within the heat exchanger, but the temperature of the refrigerant is reduced from the third temperature $T_3$ to the fourth temperature $T_4$.

After being run through the one or more first heat exchangers during the operation 308, the refrigerant it run through an expander, such as the expander 104, during an operation 310. Expanding the refrigerant produces power, which is used to power the first compressor during operation 304, and also reduces both the temperature and pressure of the refrigerant to a fifth state. The temperature and pressure of the refrigerant is reduces from the fourth Temperature $T_4$ and the third pressure $P_3$ to a fifth temperature $T_5$ and a fourth pressure $P_4$. The fourth pressure $P_4$ is similar to or the same as the first pressure $P_1$. The fifth temperature $T_5$ is lower than any of the first temperature the second temperature $T_2$, the third temperature $T_3$, or the fourth temperature $T_4$. Bringing the refrigerant down to the fifth temperature $T_5$ enables the refrigerant to used as a cooling medium.

After the refrigerant is expanded during operation 310, the refrigerant is run through one or more second heat exchangers during an operation 312. The one or more second heat exchangers may be the second heat exchanger system 103, such as the fourth heat exchanger 103*a* and the fifth heat exchanger 103*b* of FIG. 2. Running the refrigerant through the one or more second heat exchangers brings the temperature of the refrigerant up to a sixth temperature $T_6$. The sixth temperature $T_6$ may be similar to or the same as the first temperature $T_1$. In some embodiments, the sixth temperature $T_6$ is different from the first temperature $T_1$, but the refrigerant is mixed with other streams of refrigerant either in a conduit or a collection vessel, such as the collection vessel 102, to reach an equilibrium at the first temperature $T_1$. The pressure does not change from the fourth pressure $P_4$ within the second heat exchanger.

After being run through the one or more second heat exchangers during the operation 312, the refrigerant may be flowed again through the system 100, such that the refrigerant is at least partially recycled. Alternatively, there may be a way to vent at least some of the refrigerant at one or more points throughout the method 300. The refrigerant may be vented at a rate roughly equal to or less than the rate at which refrigerant is supplied using one or more circulating fluid sources, such as the circulating fluid source 110. The amount of refrigerant vented may be slightly less than the amount of refrigerant supplied using the circulating fluid sources as there may be some loss of refrigerant at various joints and connections within the system 100.

The refrigerant within the system 100 is a gas or in a vapor phase throughout the entire method 300. Keeping the refrigerant as a gas or in a vapor phase reduces the mechanical complexity of components within the system 100 and enables the cost of maintenance and manufacturing of the system 100 to be decreased. The use of exhaust as a refrigerant, which can be vented as necessary, further decouples the use of the system 100 from the location of other refrigerant sources, such as a nearby water reservoir. The use of exhaust as a refrigerant further reduces additional capital and maintenance costs. Utilizing exhaust from a piece of infrastructure, such as the infrastructure 200, is also beneficial as the heat of the exhaust is able to be fully utilized instead of attempting to utilize a heat exchanger to transfer the low level heat of the exhaust to water or steam. The use of the low-level heat within the exhaust further reduces energy expenditures for heating of a separate refrigerant and makes the overall heating and cooling cycle more efficient.

Please find the appendix attached. While the foregoing is directed to embodiments of the present disclosure, other and further embodiments of the disclosure may be devised without departing from the basic scope thereof, and the scope thereof is determined by the claims that follow.

What is claimed is:

1. A system comprising:

an exhaust fluid input conduit;

a compressor fluidly coupled to the exhaust fluid input conduit via a compressor inlet line;

an expander fluidly coupled to the compressor;

a first heat exchanger disposed fluidly between the compressor and the expander, such that the first heat exchanger receives a fluid from the compressor and the fluid output by the compressor is input into the expander; and one or more fluid outlet conduits;

a collection vessel disposed between the exhaust fluid input conduit and the compressor; and a second heat exchanger disposed between the expander and the collection vessel, wherein the system is configured such that the fluid is configured to flow into the system using the exhaust fluid input conduit before being flowed into the collection vessel, before being flowed into the compressor, before being flowed into the first heat exchanger, before being flowed into the expander, and before being flowed into the second heat exchanger.

2. The system of claim 1, further comprising a second compressor between the compressor and the one or more fluid outlet conduits.

3. The system of claim 2, wherein the exhaust fluid input conduit is coupled to an exhaust fluid source.

4. The system of claim 1, wherein the expander and the compressor are part of an expander-compressor and share a dual-shaft.

5. The system of claim 4, wherein the expander supplies power to the compressor.

6. The system of claim 1, wherein the collection vessel is connected to a compressor inlet of the compressor, a compressor outlet of the compressor is coupled to a first heat exchanger inlet of the first heat exchanger by one or more compressor outlet lines, a first heat exchanger outlet of the first heat exchanger is coupled to an expander inlet of the expander by an expander inlet line, an expander outlet of the expander is coupled to a second heat exchanger inlet of the second heat exchanger by an expander outlet line, and a second heat exchanger outlet of the second heat exchanger is connected to the collection vessel by a collection vessel inlet line.

7. A system comprising:

a piece of infrastructure;

an exhaust fluid input conduit fluidly coupled to an exhaust of the piece of infrastructure;

a compressor fluidly coupled to the exhaust fluid input conduit via a compressor inlet line;

a collection vessel disposed between the exhaust fluid input conduit and the compressor;

an expander fluidly coupled to the compressor;

a first heat exchanger disposed fluidly between the expander and the compressor, such that the first heat exchanger receives a fluid from the expander and the fluid output by the first heat exchanger is input into the compressor;

a second heat exchanger disposed fluidly between the compressor and the expander, such that the second heat exchanger receives the fluid from the compressor and the fluid output by the second heat exchanger is input into the expander; and one or more fluid outlet conduits, wherein the system is configured such that the fluid is configured to flow from the piece of infrastructure using the exhaust fluid input conduit before being flowed into the collection vessel, before being flowed into the compressor, before being flowed into the second heat exchanger, before being flowed into the expander, and before being flowed into the first heat exchanger.

8. The system of claim 7, wherein the piece of infrastructure is a power plant, a liquefied natural gas production plant, a refinery, a petrochemical production plant, or a steel production plant.

9. The system of claim 7, wherein the fluid is an exhaust gas and a filter is utilized to filter the exhaust gas from the piece of infrastructure before the exhaust gas enters the exhaust fluid input conduit.

10. The system of claim 7, wherein the second heat exchanger is a feed gas cooler and the first heat exchanger is a reboiler for heating of a process fluid within the piece of infrastructure.

11. The system of claim 10, wherein the piece of infrastructure further includes a stripper, an absorber, and a knock-out drum and the exhaust supplies exhaust gas from the knock-out drum.

12. The system of claim 7, further comprising a second compressor disposed between the compressor and the second heat exchanger.

13. The system of claim 12, wherein the second compressor is electrically coupled to a power supply.

14. A method of operating a heating and cooling system, comprising:

receiving an exhaust gas from a piece of infrastructure;

compressing the exhaust gas using a compressor;

compressing the exhaust gas using a second compressor;

running the exhaust gas through a first heat exchanger after compressing the exhaust gas in the second compressor;

expanding the exhaust gas using an expander after running the exhaust gas through the first heat exchanger;

running the exhaust gas through a second heat exchanger after the exhaust gas is expanded in the expander; and exhausting the exhaust gas from the heating and cooling system after expanding or compressing the exhaust gas.

* * * * *